US009896971B2

(12) United States Patent
Richardson

(10) Patent No.: US 9,896,971 B2
(45) Date of Patent: Feb. 20, 2018

(54) LUG FOR PREVENTING ROTATION OF A STATOR VANE ARRANGEMENT RELATIVE TO A TURBINE ENGINE CASE

(71) Applicant: Carl S. Richardson, South Berwick, ME (US)

(72) Inventor: Carl S. Richardson, South Berwick, ME (US)

(73) Assignee: United Technologies Corporation, Farmington, CT (US)

( * ) Notice: Subject to any disclaimer, the term of this patent is extended or adjusted under 35 U.S.C. 154(b) by 1323 days.

(21) Appl. No.: 13/630,165

(22) Filed: Sep. 28, 2012

(65) Prior Publication Data

US 2014/0219791 A1 Aug. 7, 2014

(51) Int. Cl.
*F01D 25/24* (2006.01)
*F01D 9/04* (2006.01)

(52) U.S. Cl.
CPC ..... *F01D 25/246* (2013.01); *F01D 9/042* (2013.01); *F05D 2250/131* (2013.01); *F05D 2260/30* (2013.01)

(58) Field of Classification Search
CPC ..... F01D 9/00; F01D 9/02; F01D 9/04; F01D 9/041; F01D 9/042; F01D 25/246; F01D 25/24; F05D 2250/131; F05D 2260/30
USPC ..... 415/191, 189, 190, 193
See application file for complete search history.

(56) References Cited

U.S. PATENT DOCUMENTS 2,898,798 A * 8/1959 Carno ..... F16B 19/1081 411/80.2
4,522,559 A * 6/1985 Burge ..... F01D 25/26 415/138
4,639,189 A 1/1987 Rosman
4,921,401 A * 5/1990 Hall ..... F01D 9/04 403/28
5,584,654 A 12/1996 Schaefer et al.
5,775,874 A 7/1998 Boite et al.
5,961,278 A * 10/1999 Dorais ..... F01D 9/042 415/137
6,425,736 B1 7/2002 McMahon et al.
6,467,988 B1 * 10/2002 Czachor ..... F01D 25/243 403/337
6,537,022 B1 3/2003 Housley et al.
6,773,228 B2 8/2004 Rainous et al.
6,901,821 B2 6/2005 Torrance et al.
6,913,441 B2 * 7/2005 Fadok ..... F01D 25/246 415/189
7,144,218 B2 12/2006 Dube et al.
(Continued)

FOREIGN PATENT DOCUMENTS

GB 800098 A * 8/1958 ..... F01D 9/042

*Primary Examiner* — Woody Lee, Jr.
*Assistant Examiner* — Joshua R Beebe
(74) *Attorney, Agent, or Firm* — O'Shea Getz P.C.

(57) ABSTRACT

An assembly for a turbine engine includes a stator vane arrangement and an anti-rotation lug that is rotatably connected to a turbine engine case. The stator vane arrangement includes a platform, an airfoil and an anti-rotation slot. The platform extends circumferentially around an axial centerline and is engaged with the case. The airfoil extends radially from the platform and is arranged circumferentially around the centerline. The slot extends radially into the platform, and is mated with the lug. The lug is configured with a substantially equilateral polygonal geometry.

21 Claims, 3 Drawing Sheets

(56) References Cited

U.S. PATENT DOCUMENTS

| | | | | |
|---|---|---|---|---|
| 8,932,022 | B2 * | 1/2015 | Ivakitch | F16D 1/076 416/204 R |
| 2002/0197153 | A1 * | 12/2002 | Rogers | F01D 9/04 415/137 |
| 2003/0068225 | A1 * | 4/2003 | Housley | F01D 25/246 415/189 |
| 2006/0153683 | A1 * | 7/2006 | Dube | F01D 25/246 416/220 R |
| 2007/0122270 | A1 * | 5/2007 | Brueckner | F01D 9/042 415/191 |
| 2007/0231132 | A1 * | 10/2007 | Durand | F01D 11/12 415/209.2 |
| 2009/0162192 | A1 * | 6/2009 | McCaffrey | F01D 17/162 415/160 |
| 2010/0061844 | A1 * | 3/2010 | Hudson | F01D 9/042 415/189 |
| 2011/0219784 | A1 | 9/2011 | St. Mary et al. | |
| 2011/0243722 | A1 | 10/2011 | Murphy et al. | |
| 2011/0243725 | A1 | 10/2011 | Jones et al. | |
| 2012/0082540 | A1 * | 4/2012 | Dziech | F01D 11/005 415/173.1 |
| 2012/0128497 | A1 | 5/2012 | Rowley et al. | |
| 2012/0134791 | A1 * | 5/2012 | Brunt | F01D 25/246 415/189 |
| 2012/0195755 | A1 * | 8/2012 | Gasmen | F01D 17/162 415/230 |

* cited by examiner

LUG FOR PREVENTING ROTATION OF A STATOR VANE ARRANGEMENT RELATIVE TO A TURBINE ENGINE CASE

BACKGROUND OF THE INVENTION

1. Technical Field

This disclosure relates generally to a turbine engine and, more particularly, to a lug for preventing rotation of a stator vane arrangement relative to a turbine engine case.

2. Background Information

A stator vane arrangement for a typical turbine engine includes a plurality of stator vane airfoils circumferentially arranged around an axial centerline. The airfoils may extend radially between a radial inner platform and a radial outer platform. The outer platform may include a plurality of hooks that are mated with corresponding annular grooves in a turbine engine case. These hooks prevent the stator vane arrangement from moving radially and/or axially relative to the turbine engine case. A plurality of anti-rotation locks are provided to prevent the stator vane arrangement from rotating relative to the turbine engine case.

Various types of anti-rotation locks are known in the art. One such anti-rotation lock includes a rectangular lug that is connected to the turbine engine case with a plurality of fasteners. The rectangular lug is mated with a corresponding slot in the outer platform and, thereby, prevents the stator vane arrangement from rotating relative to the turbine engine case.

There is a need in the art for an improved anti-rotation lock.

SUMMARY OF THE DISCLOSURE

According to an aspect of the invention, an assembly is provided for a turbine engine wherein the assembly includes a stator vane arrangement and an anti-rotation lug that is rotatably connected to a turbine engine case. The stator vane arrangement includes a platform, an airfoil and an anti-rotation slot. The platform extends circumferentially around an axial centerline and is engaged with the case. The airfoil extends radially from the platform and is arranged circumferentially around the centerline. The slot extends radially into the platform, and is mated with the lug, which is configured with a substantially equilateral polygonal geometry.

According to another aspect of the invention, a turbine engine is provided that includes a core, a casing, a stator vane arrangement and an anti-rotation lug. The core includes a compressor section, a combustor section and a turbine section. The casing houses at least a portion of the core. The stator vane arrangement includes a platform, a plurality of airfoils and an anti-rotation slot. The platform extends circumferentially around an axial centerline and is engaged with the case. The airfoils extend radially from the platform and are arranged circumferentially around the centerline. The slot extends radially into the platform and is mated with the lug, which has a substantially equilateral polygonal geometry.

The substantially equilateral polygonal geometry may be a substantially square geometry with or without one or more chamfered corners.

The lug may have an axial lug width and a lateral lug width, which is substantially equal to the axial lug width.

The lug may include a plurality of platform engagement surfaces. One of the platform engagement surfaces may laterally engage (e.g., contact) a side surface of the slot.

A fastener may rotatably connect the lug to the case. The fastener may be axially and laterally centered to the lug.

The slot may also extend axially into the platform. The slot, for example, may extend axially into the platform through a hook of the platform. The hook may mate with an annular groove that extends axially into the case.

The slot may be one of a plurality of anti-rotation slots that are arranged circumferentially around the centerline. The lug may be one of a plurality of anti-rotation lugs that are respectively mated with the slots. The platform may include a plurality of arcuate platform segments. One or more of the platform segments may each be arranged with one or more of the airfoils and/or one of the slots.

The airfoils may extend radially inwards from the platform. Alternatively, the airfoils may extend radially outwards from the platform.

The stator vane arrangement may be arranged with the compressor section. Alternatively, the stator vane arrangement may be arranged with the turbine section.

The foregoing features and the operation of the invention will become more apparent in light of the following description and the accompanying drawings.

DETAILED DESCRIPTION OF THE INVENTION

Figure 1:
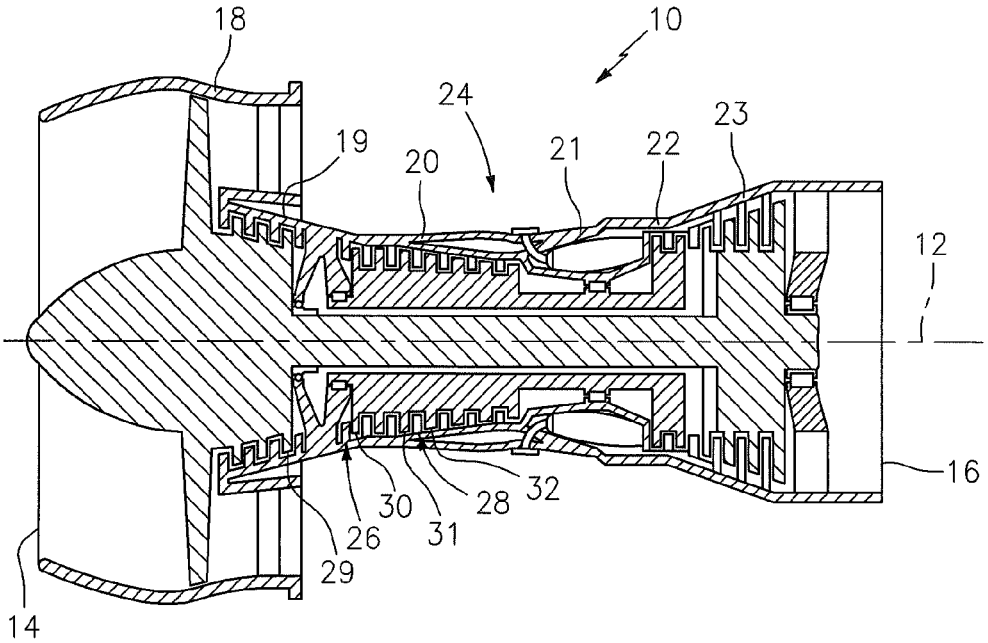
FIG. 1 is a sectional illustration of a turbine engine.

FIG. 1 illustrates a turbine engine 10 that extends along an axial centerline 12 between an upstream, airflow inlet 14 and a downstream, airflow exhaust 16. The turbine engine 10 includes a plurality of sections such as, for example, a fan section 18, one or more (e.g., low and high pressure) compressor sections 19 and 20, a combustor section 21, and one or more (e.g., high and low pressure) turbine sections 22 and 23, which are sequentially arranged along the centerline 12. The one or more compressor sections 19 and 20, the combustor section 21 and the one or more turbine sections 22 and 23 collectively form a core 24 of the turbine engine 10.

The turbine engine 10 also includes one or more stator assemblies (e.g., 26 and 28). At least one of the stator assemblies may be configured to guide gas between two of the turbine engine sections 18-23. The stator assembly 26, for example, is configured to guide core gas from a rotor stage 29 of the compressor section 19 to an axially adjacent rotor stage 30 of the compressor section 20. At least one of the stator assemblies may also or alternatively be configured to guide gas between adjacent rotor stages of a respective one of the turbine engine sections 18-23. The stator assembly 28, for example, is configured to guide core gas between adjacent rotor stages 31 and 32 of the compressor section 20.

Figure 2:
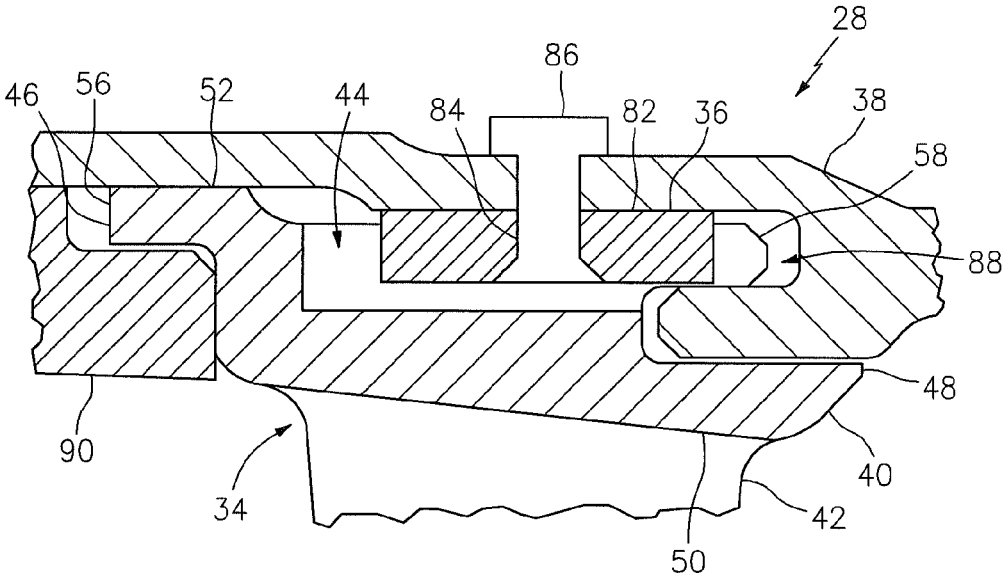
FIG. 2 is an enlarged sectional illustration of a portion of the turbine engine of FIG. 1.
Figure 3:
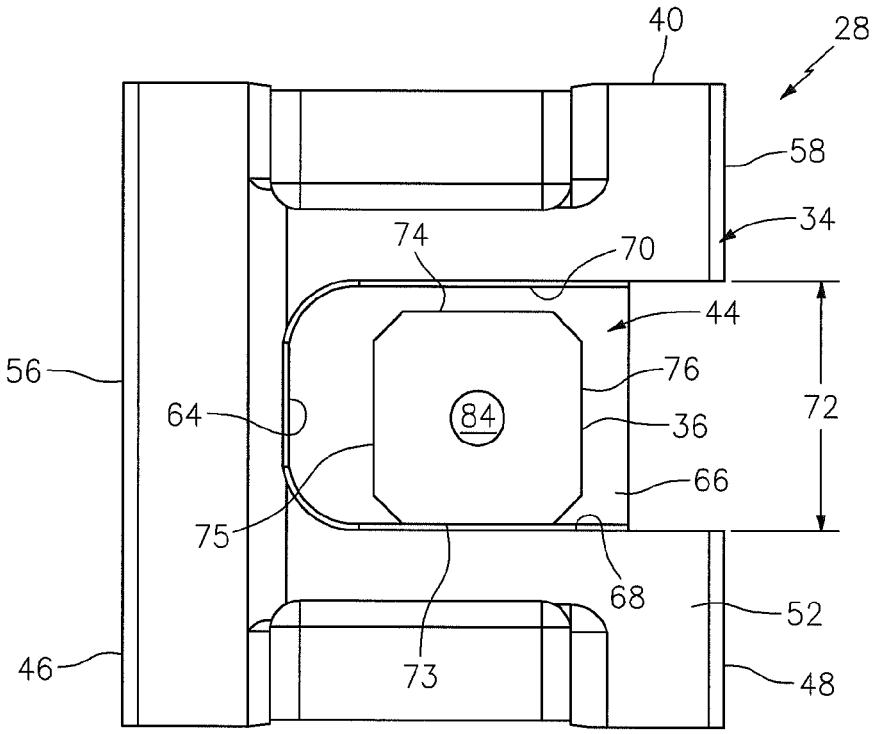
FIG. 3 is an enlarged side illustration of a portion of the turbine engine of FIG. 1.

Referring to FIGS. 2 and 3, one or more of the stator assemblies (e.g., the stator assembly 28) includes a stator vane arrangement 34, one or more anti-rotation lugs 36 (e.g., anti-rotation locks), and a turbine engine case 38 that may house, for example, at least a portion of the core 24 (see FIG. 1). The stator vane arrangement 34 includes an annular outer vane arrangement platform 40, a plurality of stator vane airfoils 42, and one or more anti-rotation slots 44.

Figure 4:
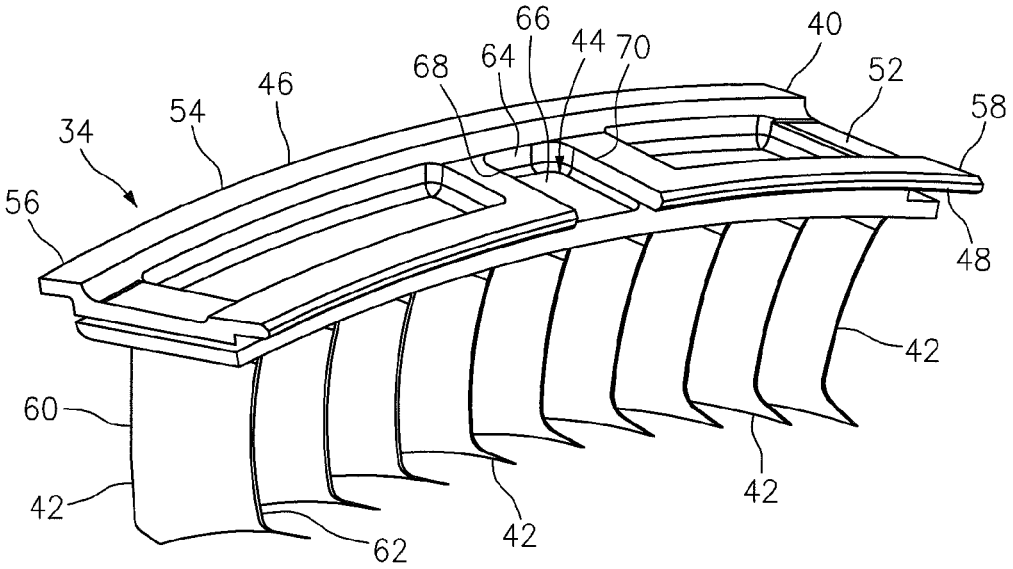
FIG. 4 is a perspective illustration of a segment of a stator vane arrangement included in the turbine engine of FIG. 1.

The platform 40 extends axially between a first (e.g., upstream) platform end 46 and a second (e.g., downstream) platform end 48. The platform 40 extends radially between a first platform surface 50 (e.g., a radial inner gaspath surface) and a second platform surface 52 (e.g., a radial outer surface). The platform 40 also extends circumferentially around the centerline 12 (see FIG. 1). The platform 40 may include a plurality of arcuate platform segments 54, one of which is illustrated in FIG. 4. The platform segment 54 embodiment of FIG. 4 includes a first hook 56 and a second hook 58. The first hook 56 includes an arcuate, axially extending flange arranged at (e.g., adjacent or proximate) the first platform end 46. The second hook 58 includes an arcuate, axially extending flange arranged at the second platform end 48.

One or more of the airfoils 42 extend radially (e.g., inwards) from the respective platform segment 54, and are arranged circumferentially about the centerline 12 (see FIG. 1). Each of the airfoils 42 extends axially between a leading edge 60 and a trailing edge 62. Each of the vane airfoils 42 also extends laterally (e.g., generally circumferentially or tangentially) between a concave surface and a convex surface. In the embodiment of FIG. 4, the airfoils 42 and the respective platform segment 54 are formed (e.g., cast) as a unitary body.

Each of the slots 44 extends axially into a respective one of the platform segments 54 and through the second hook 58 to a distal end surface 64. Each of the slots 44 extends radially into the respective platform segment 54 from the second platform surface 52 to a distal end surface 66. Each of the slots 44 extends laterally between a first side surface 68 and a second side surface 70, which defines a lateral slot width 72 as illustrated in FIG. 3.

Figure 5:
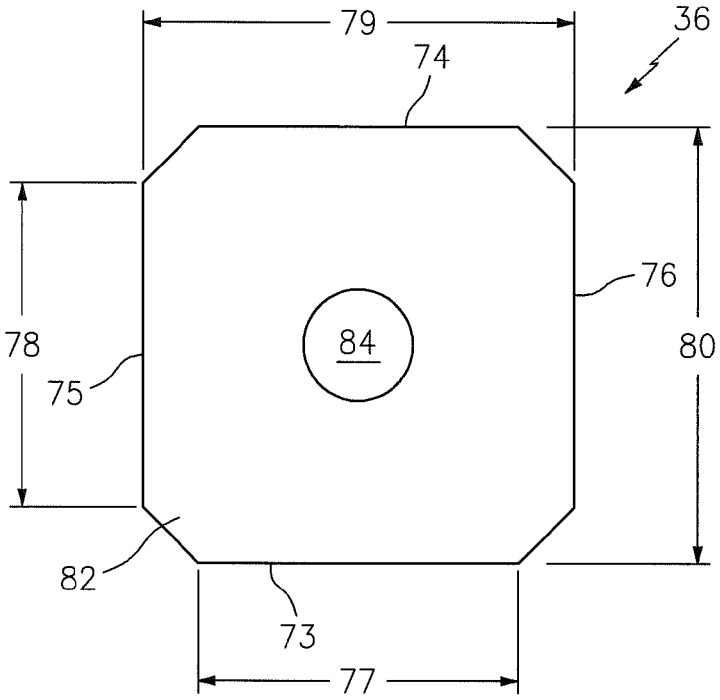
FIG. 5 is an illustration of a side of an anti-rotation lug included in the turbine engine of FIG. 1.
Figure 6:
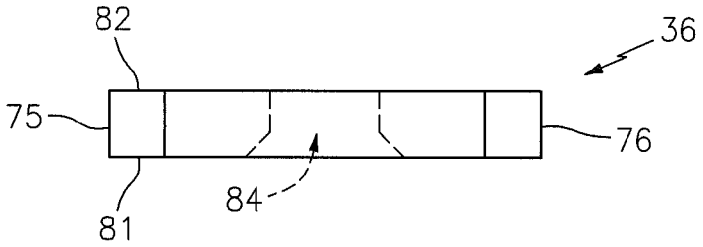
FIG. 6 is an illustration of an end of the anti-rotation lug of FIG. 5.

Referring to FIG. 5, one or more (e.g., each) of the lugs 36 is configured with a substantially equilateral polygonal geometry. Each of the lugs 36, for example, includes a plurality of platform engagement surfaces (e.g., 73-76) with substantially equal widths (e.g., 77 and 78). In the embodiment of FIG. 5, each of the lugs 36 has a substantially square geometry with one or more chamfered corners, and each lug 36 extends axially between the platform engagement surfaces 75 and 76, which defines an axial lug width 79. Each of the lugs 36 extends laterally between the platform engagement surfaces 73 and 74, which defines a lateral lug width 80. The lateral lug width 80 may be substantially equal to the axial lug width 79 as well as less than the lateral slot width 72 (see FIG. 3). Referring to FIG. 6, each of the lugs 36 extends radially between a first (e.g., radial inner) end surface 81 and a second (e.g., radial outer) end surface 82. Referring now to FIGS. 5 and 6, each of the lugs 36 includes a fastener aperture 84 that is axially and laterally centered between the engagement surfaces 73-76. The fastener aperture 84 extends radially through the respective lug 36 between the first and the second end surfaces 81 and 82.

Referring to FIG. 2, each of the lugs 36 is rotatably connected to the case 38 with a respective fastener 86 (e.g., rivet, bolt, etc.), which is mated with the fastener aperture 84. Each of the lugs 36 is mated with (e.g., arranged in or extends into) a respective one of the slots 44. Each of the second hooks 58 is mated with an annular groove 88 that extends axially into the case 38. Each of the first hooks 56 is arranged radially between an annular air seal 90 and the case 38. In this manner, the first and second hooks 56 and 58 may axially and/or radially constrain movement of the stator vane arrangement 34 relative to the case 38. The lugs 36 may circumferentially constrain movement of the stator vane arrangement 34 relative to the case 38. Referring to FIG. 3, for example, one of the platform engagement surfaces 73-76 (e.g., engagement surface 73) may engage (e.g., contact) one of the side surfaces 68 and 70 (e.g., the first side surface 68) to prevent the stator vane arrangement 34 from rotating relative to the case 38.

The equilateral polygonal geometry of the lugs 36 may reduce the complexity and/or cost of manufacturing the turbine engine 10. The equilateral polygonal geometry, for example, enables the lugs 36 to be connected to the case 38 without concern for which ones of the platform engagement surfaces 73-76 are adjacent to the side surfaces 68 and 70. In addition, a misalignment between the platform engagement surface 73 and the first side surface 68 may be self-corrected when the respective lug 36 initially engages the platform 40 since the lug 36 may rotate about the fastener 86. The equilateral polygonal geometry of the lugs 36 may also or alternatively reduce the complexity and/or cost of maintaining the turbine engine 10. Instead of replacing the lug 36 when the platform engagement surface 73 has become worn, for example, the lug 36 may be rotated about the fastener 86 a quarter, a half or three-quarters of a turn, for example, such that another one of the platform engagement surfaces 74-76 engages the first side surface 68. The equilateral polygonal geometry therefore may increase the service life of the lug 36 by four times.

Figure 7:
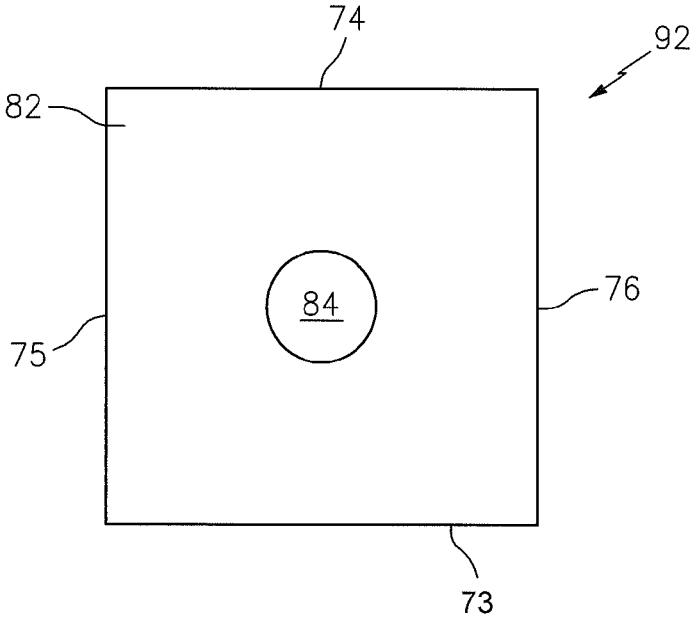
FIG. 7 is an illustration of a side of an alternate embodiment anti-rotation lug.

FIG. 7 illustrates an alternate embodiment anti-rotation lug 92. In contrast to the lug 36 of FIG. 5, the substantially equilateral polygonal geometry of the lug 92 is square without chamfered corners. The present invention, of course, is not limited to any particular equilateral polygonal geometry.

In some embodiments, the stator vane arrangement may also include an annular inner vane arrangement platform. The airfoils may extend radially between the inner and outer vane arrangement platforms. The present invention, however, is not limited to any particular stator vane arrangement configuration.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. An assembly for a turbine engine, comprising:

a turbine engine case;

a stator vane arrangement including a platform, an airfoil and an anti-rotation slot, the platform extending circumferentially around an axial centerline and engaged with the case, the airfoil extending radially from the platform and arranged circumferentially around the centerline, and the slot extending radially and axially into the platform; and an anti-rotation lug mated with the slot and rotatably connected to the case, wherein the lug is configured with a substantially equilateral polygonal geometry;

wherein the anti-rotation lug is rotatably connected to the case by a rivet.

2. The assembly of claim 1, wherein the equilateral polygonal geometry comprises a substantially square geometry.

3. The assembly of claim 2, wherein one or more corners of the lug are chamfered.

4. The assembly of claim 1, wherein the lug has an axial lug width and a lateral lug width substantially equal to the axial lug width.

5. The assembly of claim 1, wherein the lug includes a plurality of platform engagement surfaces, and one of the platform engagement surfaces laterally engages a side surface of the slot.

6. The assembly of claim 1, wherein the rivet is axially and laterally centered to the lug.

7. The assembly of claim 1, wherein the slot further extends axially into the platform.

8. The assembly of claim 1, wherein an annular groove extends axially into the case, the platform includes a hook that mates with the groove, the slot extends axially through the hook, and the anti-rotation lug is partially disposed within the groove.

9. The assembly of claim 1, wherein the slot is one of a plurality of anti-rotation slots that are arranged circumferentially around the centerline, and the lug is one of a plurality of anti-rotation lugs that are respectively mated with the slots.

10. The assembly of claim 1, wherein the platform includes an arcuate platform segment that is arranged with the airfoil and the slot.

11. The assembly of claim 1, wherein the airfoil extends radially inwards from the platform.

12. The assembly of claim 1, further comprising:

an annular air seal, a groove extending axially into the annular air seal;

wherein the platform includes a hook that mates with and extends axially into the groove.

13. A turbine engine, comprising:

a core including a compressor section, a combustor section and a turbine section;

a case that houses at least a portion of the core;

a stator vane arrangement including a platform, a plurality of airfoils and an anti-rotation slot, the platform extending circumferentially around an axial centerline and engaged with the case, the airfoils extending radially from the platform and arranged circumferentially around the centerline, and the slot extending radially into the platform; and an anti-rotation lug mated with the slot and rotatably connected to the case, wherein the lug has a substantially equilateral polygonal geometry;

wherein the anti-rotation lug is rotatably connected to the case by a rivet.

14. The engine of claim 13, wherein the stator vane arrangement is arranged with the compressor section.

15. The engine of claim 13, wherein the stator vane arrangement is arranged with the turbine section.

16. The engine of claim 13, wherein the equilateral polygonal geometry comprises a substantially square geometry.

17. The engine of claim 13, wherein the lug has an axial lug width and a lateral lug width that is substantially equal to the axial lug width.

18. The engine of claim 13, wherein the lug includes a plurality of platform engagement surfaces, and one of the platform engagement surfaces laterally engages a side surface of the slot.

19. The engine of claim 13, wherein an annular groove extends axially into the case, the platform includes a hook that mates with the groove, and the slot extends axially through the hook.

20. The engine of claim 13, wherein the slot is one of a plurality of anti-rotation slots that are arranged circumferentially around the centerline, and the lug is one of a plurality of anti-rotation lugs that are respectively mated with the slots.

21. The engine of claim 20, wherein the platform includes a plurality of arcuate platform segments, and one or more of the platform segments are each arranged with one or more of the airfoils and one of the slots.

* * * * *